US006927650B2

(12) United States Patent
Okamoto

(10) Patent No.: US 6,927,650 B2
(45) Date of Patent: Aug. 9, 2005

(54) COMMON MODE CHOKE COIL WITH VERTICALLY ARRANGED EDGEWISE WINDINGS OF RECTANGULAR WIRE

(75) Inventor: Toshinori Okamoto, Iwata-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 104 days.

(21) Appl. No.: 10/689,992

(22) Filed: Oct. 22, 2003

(65) Prior Publication Data

US 2004/0169567 A1 Sep. 2, 2004

(30) Foreign Application Priority Data

Nov. 11, 2002 (JP) ..... 2002-326670

(51) Int. Cl.[7] ..... H01F 27/28

(52) U.S. Cl. ..... 333/181; 336/90; 336/198; 336/232

(58) Field of Search ..... 333/12, 181, 185; 336/83, 90, 192, 198, 199, 205, 212, 210, 232, 200

(56) References Cited

U.S. PATENT DOCUMENTS 4,352,080 A * 9/1982 Mitsui et al. ..... 336/83
5,793,273 A * 8/1998 Yamaguchi et al. ..... 333/181
2004/0041676 A1 * 3/2004 Okamoto ..... 336/90
2004/0100347 A1 * 5/2004 Okamoto ..... 336/83

FOREIGN PATENT DOCUMENTS

JP 09260164 A * 10/1997 ..... H01F/37/00
JP 10241955 A * 9/1998 ..... H01F/27/28
JP 2000200723 A * 7/2000 ..... H01F/37/00
JP 2001274023 A * 10/2001 ..... H01F/27/06

* cited by examiner

*Primary Examiner*—Seungsook Ham
(74) *Attorney, Agent, or Firm*—Oliff & Berridge, PLC

(57) ABSTRACT

A common mode choke coil comprises: a holder including side walls which have wire guide strips respectively formed at their sides and which have vertical guide grooves and horizontal flange stoppers both formed at their inner side surfaces; a coil assembly with edgewise windings of a rectangular wire provided around a bobbin with flanges; and a core securing plate spring, wherein the coil assembly is fixedly set in a correct position inside the holder such that protrusions formed at the flanges are put through the guide grooves thereby fixedly holding the bobbin in place horizontally while the flanges are locked by the flange stoppers thereby fixedly holding the bobbin in place vertically, and wherein lead wires of the edgewise windings are bent at upper ends of the wire guide strips, and then extend along the wire guide strips.

3 Claims, 4 Drawing Sheets

COMMON MODE CHOKE COIL WITH VERTICALLY ARRANGED EDGEWISE WINDINGS OF RECTANGULAR WIRE

BACKGROUND OF THE INVENTION

1. Field of the Invention

The present invention relates to a common mode choke coil, and more particularly to a common mode choke coil having edgewise windings of a rectangular insulated wire.

2. Description of the Related Art

In recent years, since the miniaturization and enhanced performance of an electronic apparatus have been strongly demanded, a common mode choke coil used in a line filter is required to be downsized and improve in performance. Conventionally, a common mode choke coil mostly uses windings of a round insulated wire but recently uses edgewise windings of a rectangular insulated wire increasingly because the edgewise winding has the following advantages over the winding of a round insulated wire. Firstly, the edgewise winding can better achieve higher performance, higher efficiency, miniaturization and lower-profile due to its larger conductor occupation ratio. Secondly, the edgewise winding has a smaller stray capacity and therefore can realize better frequency characteristics. And thirdly, the edgewise winding does not require a process of winding a wire on a bobbin and is easier to assemble, resulting in an easier automation of the manufacturing process. The edgewise winding is formed using a special tool such that a flat rectangular insulated wire, shaped like a foil, is wound with a bottom flat surface of a winding layer stacked on a top flat surface of the previous winding layer (refer to Japanese Patent Publication No. H04-75303).

A coil device using the edgewise winding described above is disclosed, for example, in Japanese Patent Publication No. H10-241955 (refer to FIG. 6 therein), which comprises: a magnetic core; two edgewise windings formed of a rectangular wire, each having two lead wires, and provided around legs of the magnetic core; and a resin case composed of a case body and a case cover, and housing the edgewise windings. In the coil device, at least one of the lead wires of each of the edgewise windings is inserted in a groove formed inside the case body, and a harness lead wire is inserted in a hole formed in the lead wire and soldered to the lead wire.

A surface mount type choke coil is disclosed, for example, in Japanese Patent Publication No. H08-236364 (refer to FIG. 3 therein), which is structured such that a rectangular insulated wire is wound around a magnetic core leg with its both terminations leading out respectively at both opposing sides of the core, and the both terminations have their insulation peeled off thereby constituting a pair of flat connecting portions.

Also, a surface mount type small-size coil component is disclosed, for example, in Japanese Patent Publication No. H11-345721 (refer to FIG. 1 therein), which comprises two or more windings, a bobbin, and a magnetic core of magnetic material such that at least one winding is an edgewise winding of a rectangular wire and stacked on another winding of flat type.

And, a coil device with insulation assured between terminals of windings is disclosed, for example, in Japanese Patent Publication No. H08-264338 (refer to FIG. 1 therein), which comprises a plurality of edgewise windings of a rectangular wire wound on a cylindrical bobbin. In the coil device, a partition perpendicular to the cylindrical axis of the bobbin is provided at each of both ends of the bobbin and between each of the windings, at least a portion of a magnetic core is inserted in the bobbin, terminal pins are provided at the ends of the rectangular wires of the edgewise windings, and a pair of plates opposing each other in parallel and adapted to hold the terminal pins are disposed along the cylindrical axis of the bobbin.

When any of the edgewise windings described above is wound on a bobbin, especially for a common mode choke coil, the following must be taken into consideration. Firstly, the starting and finishing ends of the winding must not be set in contact with or close to each other for preventing increase of distributed capacity due to winding. Secondly, windings of common mode must be wound on one bobbin for increasing the winding factor. And thirdly, withstand voltage between lines must be increased because currents having opposing polarities flow in windings.

Consequently, typically in a common mode choke coil of bobbin type, one bobbin is used while maintaining insulation between lines, and also the cylindrical axis of the bobbin is directed parallel to a mount board. As described above, the winding factor is increased by providing windings of common mode on one bobbin, which is considered in terms of a number of bobbins or workability of winding process. On the other hand, the winding factor can be discussed essentially from the aspect of a magnetic core such that it is not necessarily appropriate to provide windings on one bobbin in trying to effectively provide windings around a magnetic core thereby achieving a maximum inductance for the same size.

Under the circumstances described above, there is conventionally provided a common mode choke coil using edgewise windings (refer to FIG. 5) for increasing winding factor, increasing current capacity, realizing downsizing and lower profile, and for reducing distributed capacity of winding. The common mode choke coil has two edgewise windings 6 wound in common mode and provided respectively around both legs of a UU core 5 for increasing winding factor. The common mode choke coil usually has its bobbin laid horizontally as shown in FIG. 5. One reason for the horizontal arrangement is that though the rectangular wire has a smaller distributed capacity of winding than the round wire therefore showing good frequency characteristics of impedance, if the starting and finishing ends of the winding are brought in contact with or close to each other, the distributed capacity is increased resulting in loss of the advantage of the edgewise winding, which does not happen with the common mode choke coil shown in FIG. 5 that can be attached on a board with its starting and finishing ends kept from getting in contact with or close to each other. Another reason is that since the core 5 is held by a metal spring 3 which is cantilevered and therefore has a weak holding force, the core 5 is apt to move out of place when subjected to mechanical vibration resulting in deterioration of performance, which can be restrained by the horizontal arrangement for a lower profile.

FIG. 6 shows another conventional common mode choke coil which has its bobbin arranged vertically. The common mode choke coil is advantageous in requiring a smaller mounting space than the common mode choke coil of FIG. 5 but has a disadvantage that lead wires 8, when bent, are positioned close to or even in contact with edgewise windings 6, thus causing difficulties with workability. Also, in this common mode choke coil, the magnetic core, bobbin and windings are not fixed adequately against mechanical and electrical vibration, which limits its usage to special applications.

In any of the common mode choke coils shown in FIGS. 5 and 6, since the bobbin 9 is not fixed to the legs of the core 5 when attached therearound, the bobbin 9 must be fixed thereto by adhesive or the like. Also, since the edgewise windings 6 are not fixed to the bobbin 9 when attached therearound and cannot be fixed mechanically, the edgewise windings 6 must be adhesively fixed thereto. Fixing the bobbin 9 and the windings 6 by adhesive separately after attaching process results in lowering the workability and also possibly deteriorating the withstand voltage and the frequency characteristics due to adhesive applied.

SUMMARY OF THE INVENTION

The present invention has been made in light of the above circumstances, and it is an object of the present invention to provide a common mode choke coil with edgewise windings of a rectangular wire, which is greatly useful in downsizing equipments and which can be used in expanded applications.

In order to achieve the object, according to a first aspect of the present invention, a common mode choke coil comprises a holder, a coil assembly, and a core securing plate spring. The holder includes: a base section; two side walls formed respectively at both sides of the base section, and each having a slot hole toward its upper end; and wire guide strips formed respectively at both sides of each of the side walls and defining respective upper ends functioning as wire bending guides. The coil assembly includes: a square magnetic core consisting of a pair of U core pieces; a bobbin having two flanges at its both ends, respectively; and a plurality of edgewise windings each formed of a rectangular wire, provided around the bobbin, and set vertically inside the holder. The core securing plate spring has its both ends engagingly inserted through respective slot holes of the two side walls. In the common mode choke coil described above, the coil assembly is fixedly set inside the holder by means of the two flanges of the bobbin, and the core securing plate spring, and lead wires of each of the edgewise winding are bent at the upper ends of the wire guide strips, then extend along the wire guide strips, and lead out thereby constituting coil terminals.

According to a second aspect of the present invention, in the common mode choke coil of the first aspect, flange stoppers arranged horizontally and adapted to lock the two flanges of the bobbin, and guide grooves running vertically are provided at inner surfaces of the two side walls of the holder.

According to a third aspect of the present invention, in the common mode choke coil of the second aspect, the bobbin consists of: a flanged cylinder section comprising cylinders and one flange of the two flanges; and a flange section constituting the other flange of the two and having holes adapted to engage with distal ends of the cylinders of the flanged cylinder section, and the two flanges of the bobbin have protrusions at locations corresponding to the guide grooves formed at the inner surfaces of the side walls.

With the structure described above for fixing the coil assembly inside the holder without using adhesive or any additional staff, a common mode choke coil with vertically arranged edgewise windings of a rectangular wire is provided which is economically manufactured, which has a high inductance at a large current, and which has a low distribution capacity and excellent high frequency characteristics of impedance. Also, the common mode choke coil requires a smaller mounting space and achieves a higher cost performance compared with a conventional common mode choke coil with horizontally arranged edgewise windings. And, the magnetic core, bobbin and windings are securely fixed mechanically, thereby making the common mode choke coil stably resist mechanical and electrical vibration.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE PREFERRED EMBODIMENT

Figure 5:
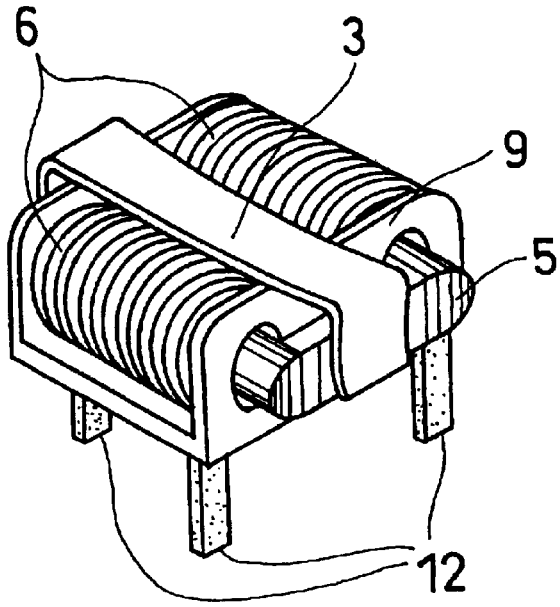
FIG. 5 PRIOR ART
FIG. 5 is a perspective view of a conventional common mode choke coil.
Figure 6:
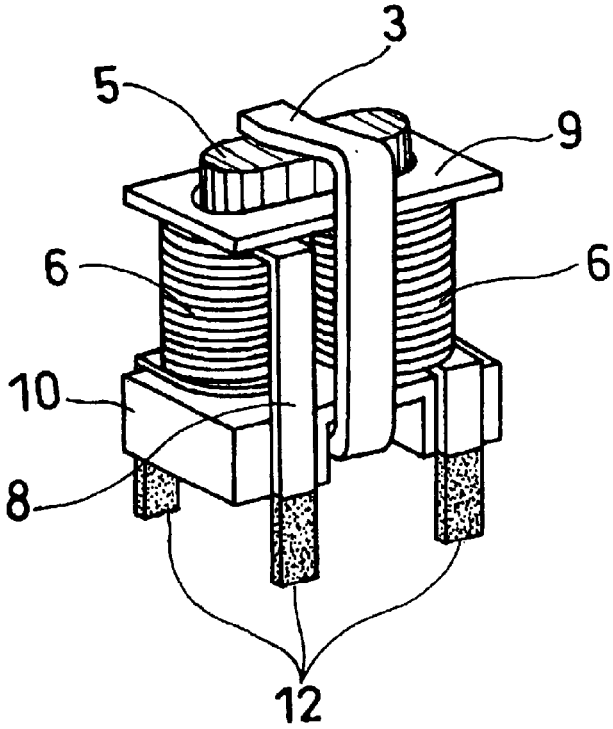
FIG. 6 PRIOR ART
FIG. 6 is a perspective view of another conventional common mode choke coil.

A preferred embodiment will hereinafter be described in detail with reference to FIGS. 1 to 4. In explaining FIGS. 1 to 4, any component parts corresponding to those in FIGS. 5 and 6 are denoted by the same reference numerals.

Figure 1:
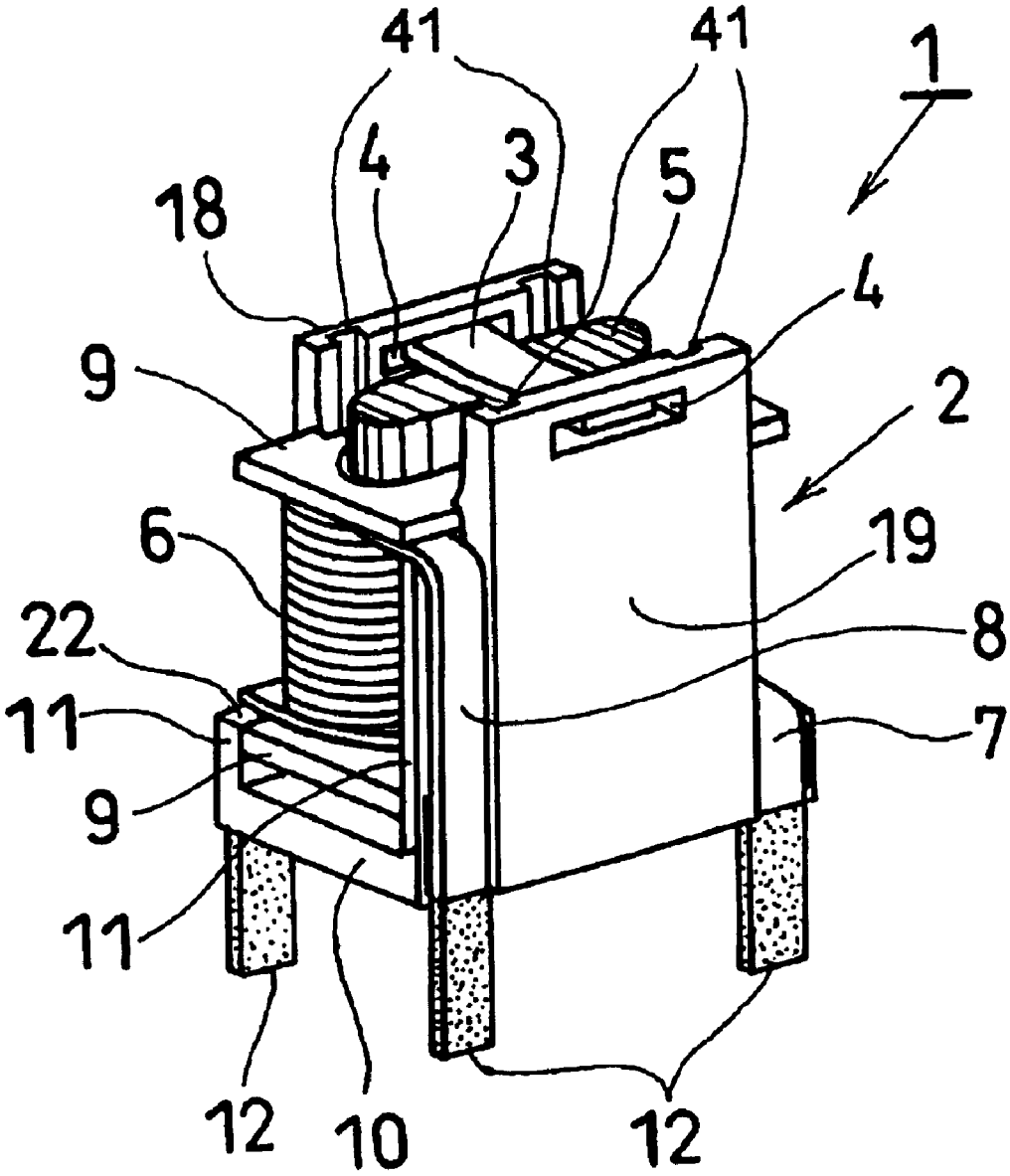
FIG. 1 is a perspective view of a common mode choke coil according to an embodiment of the present invention.
Figure 2:
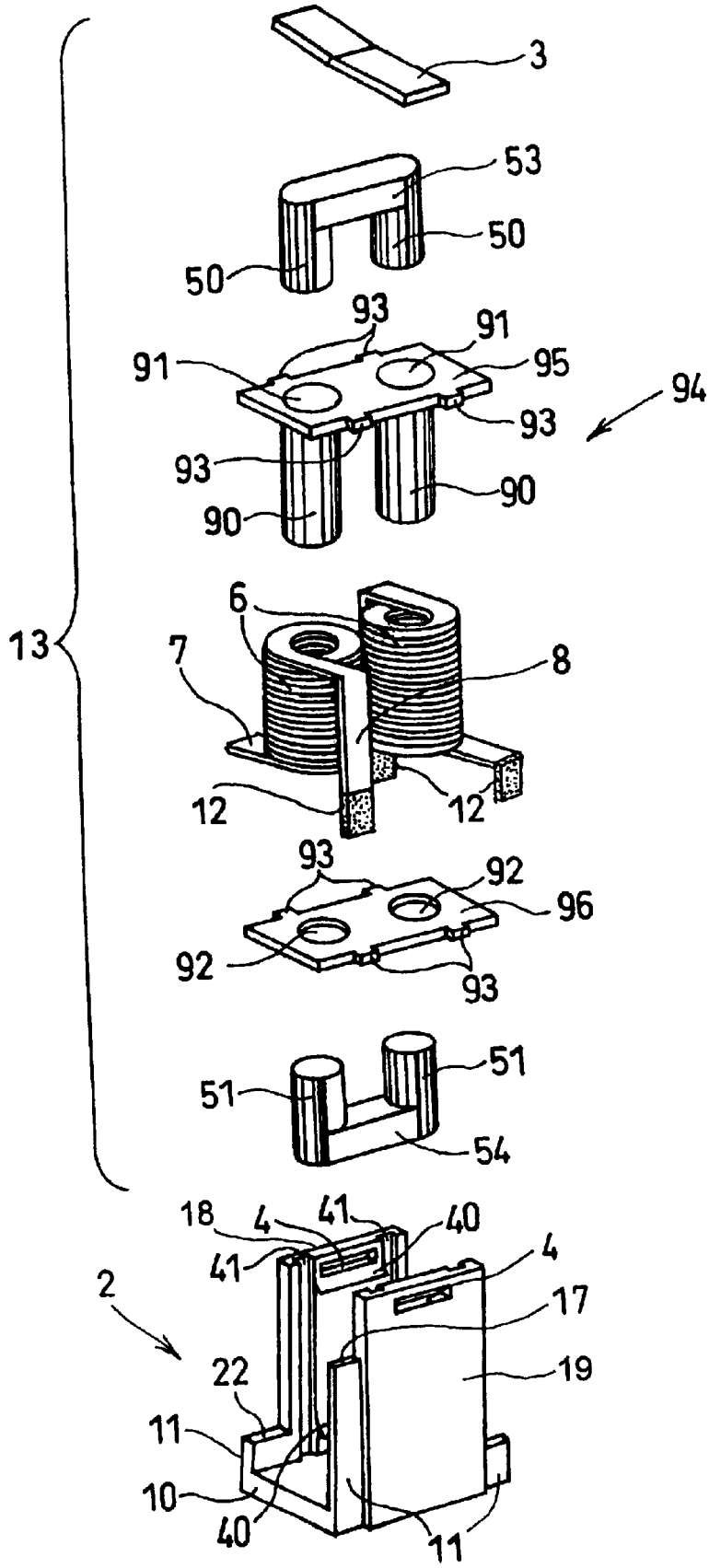
FIG. 2 is an exploded perspective view of the common mode choke coil of FIG. 1.

Referring to FIGS. 1 and 2, a common mode choke coil 1 comprises: a holder 2; a coil assembly 13 (FIG. 2) set vertically in the holder 2; and a core securing plate spring 3.

As shown in FIG. 2, the coil assembly 13 comprises: two edgewise windings 6; a square-like magnetic core 5 consisting of upper and lower U core pieces 53 and 54 (to be detailed later); and a bobbin 9 having the magnetic core 5 inserted therein. The coil section 13 is firmly set in the holder 2 by means of flange stoppers 40, protrusions 93, guide grooves 41, and the aforementioned plate spring 3 (these parts will be described later). The bobbin 9 has its cylindrical axes oriented vertical to a mount board (not shown). Ends (terminations) 12 of the edgewise windings 6 have their insulation coat peeled off and are plated with solder.

Figure 3:
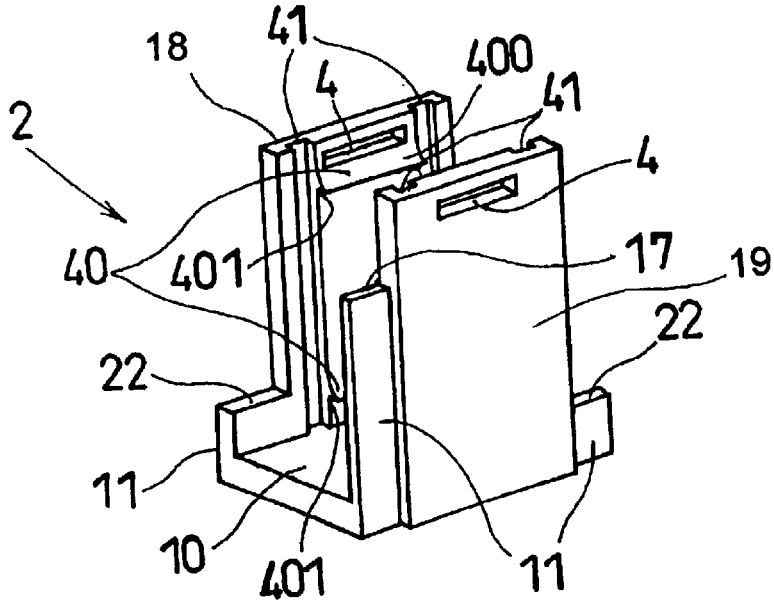
FIG. 3 is a perspective view of a holder of the common mode choke coil of FIG. 1.

Referring now to FIG. 3, the holder 2 is formed of plastic and generally comprises a base section 10 and side walls 18 and 19. The base section 10 receives the coil assembly 13 sitting thereon. The side walls 18, 19 are formed respectively at both sides of the base section 10 and have respective slot holes 4 formed toward their upper ends and adapted to have the both ends of the plate spring 3 engagingly inserted therethrough. Each of the side walls 18 and 19 has two wire guide strips 11 respectively formed at its both sides. The wire guide strips 11 have different lengths from each other, are adapted to guide rectangular wires, and have upper ends functioning as wire bending guides 17 and 22, respectively. The wire bending guides 17 and 22 have their edge angle set at, for example, 90 degrees for maintaining plastic deformation of the rectangular wire. The aforementioned flange stoppers 40 and guide grooves 41 are formed at each of the inner surfaces of the side walls 18 and 19. The flange stoppers 40 are each oriented horizontally and project with its upper surface 400 gently sloped and its lower surface 401 oriented orthogonal to the inner surfaces of the side walls 18 and 19. The guide grooves 41 run vertically and allow the coil assembly 13 to smoothly fit in a correct position inside the holder 2.

Figure 4:
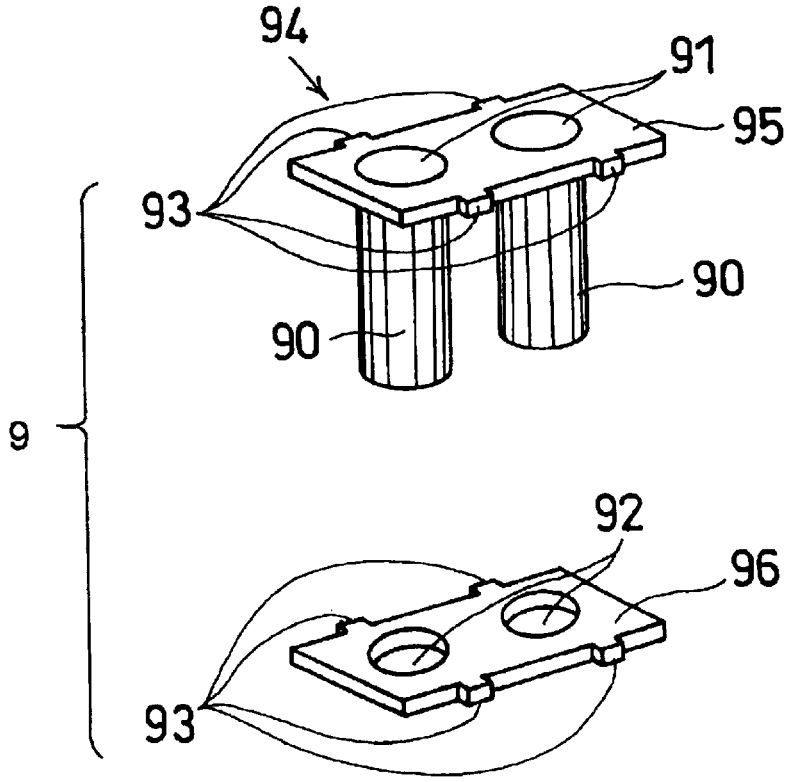
FIG. 4 is an exploded perspective view of a bobbin of the common mode choke coil of FIG. 1.

Referring to FIG. 4, the bobbin 9 consists of: a flanged cylinder section 94 having two hollow cylinders 90 and an upper flange 95; and a flange section 96 constituting a lower flange (hereinafter, the flange section is referred to also as lower flange as appropriate. The flanged cylinder section 94 and the flange section 96 are formed of plastic. The upper and lower flanges 95 and 96 have the aforementioned protrusions 93 formed at locations corresponding to the guide grooves 41. When the coil assembly 13 is set inside the holder 2, the protrusions 93 are put through respective guide grooves 41 thereby fixedly holding the bobbin 9 in place horizontally, and the upper and lower flanges 95 and 96 are locked by the flange stoppers 40 thereby fixedly holding the bobbin 9 in place vertically, thus the coil assembly 13 can be fixedly attached inside the holder 2 together with the edgewise windings 6. The protrusions 93 are dimensioned so as to move fittingly through the guide grooves 41. The flanged cylinder section 94 has two hollows 91 which constitute respective hollows of the two cylinders 90, and into which legs 50 and 51 (to be detailed later) of the aforementioned U core pieces 53 and 54 are inserted. The lower flange 96 has two holes 92 into which distal ends of the two cylinders 90 are to be engagingly inserted thereby consummating the bobbin 9. The distance between the outer surfaces of the upper and lower flanges 95 and 96 is slightly smaller than the aggregated length of the legs 50 and 51.

Referring back to FIG. 2, the assembling process of the common mode choke coil 1 will hereinafter be described. The cylinders 90 are inserted through the two edgewise windings 6, respectively, the distal ends of the cylinders 90 are fixedly engaged with the holes 92 of the lower flange 96, and the legs 50 and 53 of the core pieces 53 and 54 are inserted in the hollows 91 so as to abut against each other inside the hollows 91, thus completing the coil assembly 13. The coil assembly 13 thus completed is set inside the holder 2 with the protrusion 93 of the upper and lower flanges 95 and 96 put through the respective guide grooves 41 and pushed down all the way till the lower core piece 54 touches the base section 10 of the holder 2. When the coil assembly 13 is pushed down, the upper and lower flanges 95 and 96 push outward the side walls 18 and 19 at the flange stoppers 40 due to their upper surfaces 400 sloping and can pass the flange stoppers 40, and then the side walls 18 and 19 move inward back to their original positions, whereby the upper and lower flanges 95 and 96 are locked by the flange stoppers 40 at their lower surfaces 401. Then, the both end portions of the plate spring 3 are engagingly inserted in respective slot holes 4 so as to press down the coil assembly 13 at the upper core piece 53. Thus, the coil assembly 13 is fixedly set inside the holder 2 by means of the flange stoppers 40, the protrusions 93, the guide grooves 41 and the plate spring 3, and can thereby stably resist mechanical and electrical vibration.

After the coil assembly 13 is fixed inside the holder 2, lead wires 7, 8 of the edgewise windings 6 are plastically bent by about 90 degrees at the wire bending guides 17, 22 constituted by the upper ends of the wire guide strips 11, lead out along the wire guide strips 11 and are attached to the mount board (not shown). As a result, the lead wire 8 coming from the top of the edgewise winding vertically arranged is kept away from the winding 6 by means of the wire guide strip 11, whereby withstand voltage is assured and distributed capacity is reduced.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A common mode choke coil comprising a holder including:

a base section;

two side walls formed respectively at both sides of the base section, and each having a slot hole toward its upper end; and wire guide strips formed respectively at both sides of each of the side walls and defining respective upper ends functioning as wire bending guides, a coil assembly including:

a square magnetic core consisting of a pair of U core pieces;

a bobbin having two flanges at its both ends, respectively; and a plurality of edgewise windings each formed of a rectangular wire, provided around the bobbin, and set vertically inside the holder, and a core securing plate spring having its both end portions engagingly inserted through respective slot holes of the two side walls, wherein the coil assembly is fixedly set inside the holder by means of the two flanges of the bobbin, and the core securing plate spring, and lead wires of each of the edgewise winding are bent at the upper ends of the wire guide strips, then extend along the wire guide strips, and lead out thereby constituting coil terminals.

2. A common mode choke coil according to claim 1, wherein flange stoppers arranged horizontally and adapted to lock the two flanges of the bobbin, and guide grooves running vertically are provided at inner surfaces of the two side walls of the holder.

3. A common mode choke coil according to claim 2, wherein the bobbin consists of:

a flanged cylinder section comprising hollow cylinders and one flange of the two flanges; and a flange section constituting the other flange of the two flanges and having holes adapted to engage with distal ends of the cylinders of the flanged cylinder section, and the two flanges of the bobbin have protrusions at locations corresponding to the guide grooves formed at the inner surfaces of the side walls.

* * * * *